US007143566B2

(12) United States Patent
May et al.

(10) Patent No.: US 7,143,566 B2
(45) **Date of Patent: *Dec. 5, 2006**

(54) CLIPPER FOR AUTOMATIC NETTING PACKAGING MACHINE

(75) Inventors: Dennis J. May, Pittsboro, NC (US); Samuel D. Griggs, Raleigh, NC (US)

(73) Assignee: Delaware Capital Formation, Inc., Wilmington, DE (US)

( * ) Notice: Subject to any disclaimer, the term of this patent is extended or adjusted under 35 U.S.C. 154(b) by 13 days.

This patent is subject to a terminal disclaimer.

(21) Appl. No.: 11/042,780

(22) Filed: Jan. 25, 2005

(65) Prior Publication Data

US 2006/0042185 A1 Mar. 2, 2006

Related U.S. Application Data

(63) Continuation of application No. 10/725,142, filed on Mar. 23, 2004, now Pat. No. 6,845,596.

(60) Provisional application No. 60/478,077, filed on Jun. 12, 2003.

(51) Int. Cl.
*B65B 9/15* (2006.01)
*B65B 51/05* (2006.01)

(52) U.S. Cl. ..... 53/138.4; 53/567; 53/576

(58) Field of Classification Search ..... 53/138.4, 53/413, 417, 134.1, 567, 576; 29/243.57
See application file for complete search history.

(56) References Cited

U.S. PATENT DOCUMENTS 3,377,692 A 4/1968 Tipper (Continued)

FOREIGN PATENT DOCUMENTS

FR 2 463 059 2/1981

OTHER PUBLICATIONS

Tipper Tie Whole Bird Packaging System; www.tippertie.com/poultry/tb10.asp.
Tipper Tie TB15; www.tippertie.com/poultry/tb15.asp.
Tipper Tie Z3214; www.tippertie.com/poultry/z3214.asp.

*Primary Examiner*—John Slpos
(74) *Attorney, Agent, or Firm*—Banner & Witcoff, Ltd.

(57) ABSTRACT

Knitted netting is applied to products in a machine. A chute receives products serially through a receiving end, as from a conveyor, and discharges them serially into netting preferably rucked on the chute. As each product arrives at the product receiver, voiders operate to form a rope section of the netting behind the product, at the chute's discharge end. The clipper also clips the netting, to complete the netting of the product, and clips to create the starting end of the next netted product. A netting handle former operates to loop the rope section behind the product, before clipping, to form a looped handle for a product in the rope section of the netting. The netting that is clipped behind the products is the netting formed into the loops, and thus, the clips that are put on by the clipper secure the loops in their size and condition. The product receiver is preferably a discharge tray, and product guides on the tray straighten the product, to align it for netting, and also co-operate with the voiders to help tighten the product packaging. The clipper is also preferably uniquely structured in its clip rails to contribute to tighter packaging. The clip rails are paired on one side of the machine, with one angled and extending through a near clipper die support to reach the die of a distant die support. The chute is gravity driven and includes product ribs or rails for centering and ease of movement of products. The handle former is an essentially two-part, mechanically actuated disc and clam shell construction that reaches for the netting, captures it, and rotates a loop into it, while tightening the packaging, in co-ordination with the voiders.

13 Claims, 5 Drawing Sheets

U.S. PATENT DOCUMENTS 3,383,754 A 5/1968 Klenz
3,389,533 A 6/1968 Tipper et al.
3,726,060 A 4/1973 McMillan
4,004,339 A 1/1977 Velarde et al.
4,044,450 A 8/1977 Raudys et al.
4,165,593 A 8/1979 Niedecker
4,247,005 A 1/1981 Buxton
4,537,006 A 8/1985 Pieri
4,571,805 A 2/1986 Niedecker
4,675,945 A 6/1987 Evans et al.
4,720,010 A 1/1988 Bertram
4,766,713 A 8/1988 Evans
4,847,953 A 7/1989 Evans et al.
4,969,233 A 11/1990 Stanley
5,017,175 A 5/1991 Klusmire
5,042,234 A 8/1991 Evans et al.
5,042,238 A 8/1991 White
5,067,313 A 11/1991 Evans
5,077,955 A 1/1992 Evans
5,109,648 A 5/1992 Evans
5,165,216 A 11/1992 May et al.
5,203,759 A 4/1993 Torres et al.
5,259,168 A 11/1993 Evans et al.
5,269,054 A 12/1993 Poteat et al.
5,269,116 A 12/1993 Roberts et al.
5,476,673 A 12/1995 Sombrio
5,644,896 A 7/1997 Evans et al.
5,755,022 A 5/1998 Whittlesey
5,916,019 A 6/1999 Whittlesey
6,035,606 A 3/2000 Bussey, III et al.
6,524,178 B1 2/2003 Fässler et al.

CLIPPER FOR AUTOMATIC NETTING PACKAGING MACHINE

BACKGROUND OF THE INVENTION

This application is a continuation of U.S. application Ser. No. 10/725,142, filed Mar. 23, 2004, now U.S. Pat. No. 6,845,596 which claims priority to provisional U.S. Provisional Application Ser. No. 60/478,077, filed Jun. 12, 2003, which is incorporated herein by reference in its entirety.

This invention relates to the machines that place metal clips on chub and netted products, known as clippers, the packaging of chub and net-enclosed or netted products, and the machines and methods that form such products. This invention especially relates to the machines and methods that form net-enclosed turkeys and similar poultry and meat products, as well as potentially, net-enclosed firewood, bulk explosives, and other possible net-enclosed consumer and industrial products. It also especially relates to clippers for these and other machines.

Knitted and extruded netting is a packaging material of choice for industries including meat and poultry, aquaculture, horticulture, Christmas tree, PVC pipe, environmental, aviation, fruit and produce, toys, housewares, and the like. Knitted netting can be soft, flexible, and conformable to a variety of irregularly shaped products. Knitted netting provides air circulation, and can be decorative and protective. Tipper Tie Inc., a Dover Industries company, makes and sells desirable netting under the trademark Net-All. In meat netting, Net-All netting is used for hams, whole birds, poultry breasts, and molded meat products.

Netting is applied to products manually, semi-automatically, and fully automatically by a variety of machines and methods including the Tipper Tie Whole Bird Packaging System, the Tipper Tie Automatic Whole Bird Packaging System, Tipper Tie Model TB15, and the Tipper Tie Clipper Model Z3214. Another Tipper Tie apparatus for applying netting is shown in U.S. Pat. No. 5,042,234, issued on Aug. 27, 1991, to Alfred J. Evans et al. for a Collagen Film and Netting Packaging System and Method. A loop forming mechanism for flexible packaging material is also shown in U.S. Pat. No. 5,165,216, issued on Nov. 24, 1992 to Dennis J. May et al., for a Loop Forming Mechanism for Flexible Packaging Material. As stated in the identified Evans et al. patent, netting is sometimes placed around products to be netted when the products exits chutes or tubes around which the netting is rucked.

Machines known as clippers may place metal clips on the netting between the products, to close the netting and provide for separation of the products. Clippers are best known in the formation of chubs for sausage and similar meat products. In chub-forming applications and also in netted product applications, voiders form emptied, rope sections in the packaging material in use. Clips travel along feed rails to the clippers. Punches of the clippers then act against dies to clip the rope sections, to form the ends of the chubs or other products. A sophisticated, high speed chub-forming machine is shown in U.S. Pat. No. 5,259,168 issued on Nov. 9, 1993 to Alfred J. Evans et al. for a Continuously Rotating Platform with Multiple Mounted Double Clippers for Continuously Forming Linked Product. In that machine, pairs of clippers are fed from single clip rails, as in the drawing on the face of the patent. As explained at columns 15 and 16 of that patent, the structure of the clip feeding mechanism of that machine requires that clips be suspended above open spaces by forces against the sides, to properly locate the clips to be driven by the clipper punches.

While the existing products, machines and methods of the "netting art" and the separate "clipping art" have great value, especially those from Tipper Tie Inc., the frontier of technology is ahead of them, to be advanced further by inventive efforts.

SUMMARY OF THE INVENTION

In a first principal aspect, this invention constitutes a product netting machine. The machine comprises, in major part, a chute, a product receiver, voiders, and a clipper. The chute receives products serially through a receiving end, as from a conveyor, and discharges them serially into netting preferably rucked on the chute. As each product arrives at the product receiver, voiders operate to form a rope section of the netting behind the product, at the chute's discharge end. The clipper also clips the netting, to complete the netting of the product, and clips to create the starting end of the next netted product. The clipper includes at least two die supports, at least two punches mounted for movement on the die supports, at least two anvils, a drive or drives to intermittently drive the punches to the anvils, sidewardly adjacent clip rails, and clip pushers to feed clips from the rails to between the punches and the anvils. Successively netted and clipped products are formed by the product netting machine, and as a step of the netting and clipping, clips pass from the adjacent clip rails to between both the punches and both the anvils.

In another principal aspect, the invention constitutes a clipper for a product packaging machine, of the netting type, chub forming type and other types. The clipper comprises at least two die supports, at least two punches, at least two anvils, a drive, sidewardly adjacent clip rails, and clip pushers. The punches are mounted for movement on the die supports. The drive intermittently drives the punches to the anvils. The clip pushers feed clips from the rails to between the punches and the anvils. With a clipper as described, successively netted and clipped products are formed by the product packaging machine. As a step of the netting and clipping, clips pass from the adjacent clip rails to between both the punches and both the anvils.

As preferred, in the invented clipper, one feed rail extends across at least one of the die supports. As a step of the netting and clipping, clips pass from one side to another side of the die support along the feed rail that extends across the one of the die supports.

Also as preferred, the clipper moves in a central plane with outer sides generally parallel to the plane, and one clipper outer side is free of any outwardly extending clip rail. The clipper-free clipper outer side permits enhanced placement of clips. As well, one feed rail extends across and through at least one of the die supports. Clips pass from one side to another side of the die support.

More specifically, the clip-forming dies of the unit accommodate this angling of the clip feed rails relative to each other. The perpendicular rail has an angled die. The angled rail has a perpendicular die. More, one clip feed rail, designated a first feed rail, extends adjacent its respective die support, designated a first die support, perpendicular to the major plane of the respective die and one clip feed rail. The second feed rail extends adjacent its respective other die support, i.e., a second die support, at an angle to the perpendicular to the major plane of the respective other die. The first die support has a first clip-forming die and the second die support has a second clip-forming die. The first clip-forming die is angled to the major plane of the respective die. The second clip-forming die is perpendicular to the major plane of the respective other die.

In a third principal aspect, the invention constitutes a machine as described, with a clipper as described, among other valuable mechanisms, components and structures.

In a fourth aspect, then, the invention constitutes a method of product packaging. This method comprises moving products, preferably serially, through packaging material to enclose the product and begin the method. The packaging material is then voided behind the product to form the rope section as described with the machine, and clips are fed to clip the material, from one side of the clipper, also as described with the machine.

In a fifth aspect, the invention comprises the packaged, clipped product itself, as made by the invented method, and such products that are also potentially further weighed and tagged.

As hopefully apparent, a first object of the invention is to substantially advance the art of netting machines and methods, and clippers and clipping methods, pushing back the frontiers of these technologies, for broader, more satisfactory application of the technologies in a variety of uses.

Another set of objects is to apply netting and other packaging materials to products essentially automatically, reliably, and at high speed, where the products include comminuted materials, whole turkeys, hams, shellfish, and similar items in a variety of industries. Netting, films or other materials may be placed directly over the products or over wrapping over the products.

A third set of objects of the invention is to provide a clipper of easy operation, capable of use with an large assortment of machines and packaging materials, constructed of stainless steel, meeting USDA requirements, suitable for harsh environments, and washable for sanitation.

All these and other objects and advantages of the invention are better understood by a study of the detailed description of the preferred embodiments of the invention, which follows after a brief description of the drawing.

BRIEF DESCRIPTION OF THE DRAWING

The accompanying drawing illustrates the specific preferred embodiment of the machine of the invention. Familiarity with the machines of the prior art is assumed. The structure shown in the drawing is not the only form that the invention as claimed may take. The drawing and the following detailed description of the preferred embodiment are intended to limit the claims only as consistent with the law of claim interpretation, whereby claims are interpreted in light of the specification and drawing.

The description which follows may refer to the componentry of the machine in such spatial terms as "forward," front," "rear," "upper," "lower," "left," "right," "behind," etc. Terms such as these, which depend on the specific spatial orientation of the components, are intended for the aid of the reader, and except as incorporated into the claims, they are not intended as a limitation on the possible orientation of components in any possible alternate, but covered, embodiment of the invention. Except as consistent with the law of claim interpretation, the drawing and following description are only illustrative of the invention.

Figure 1:
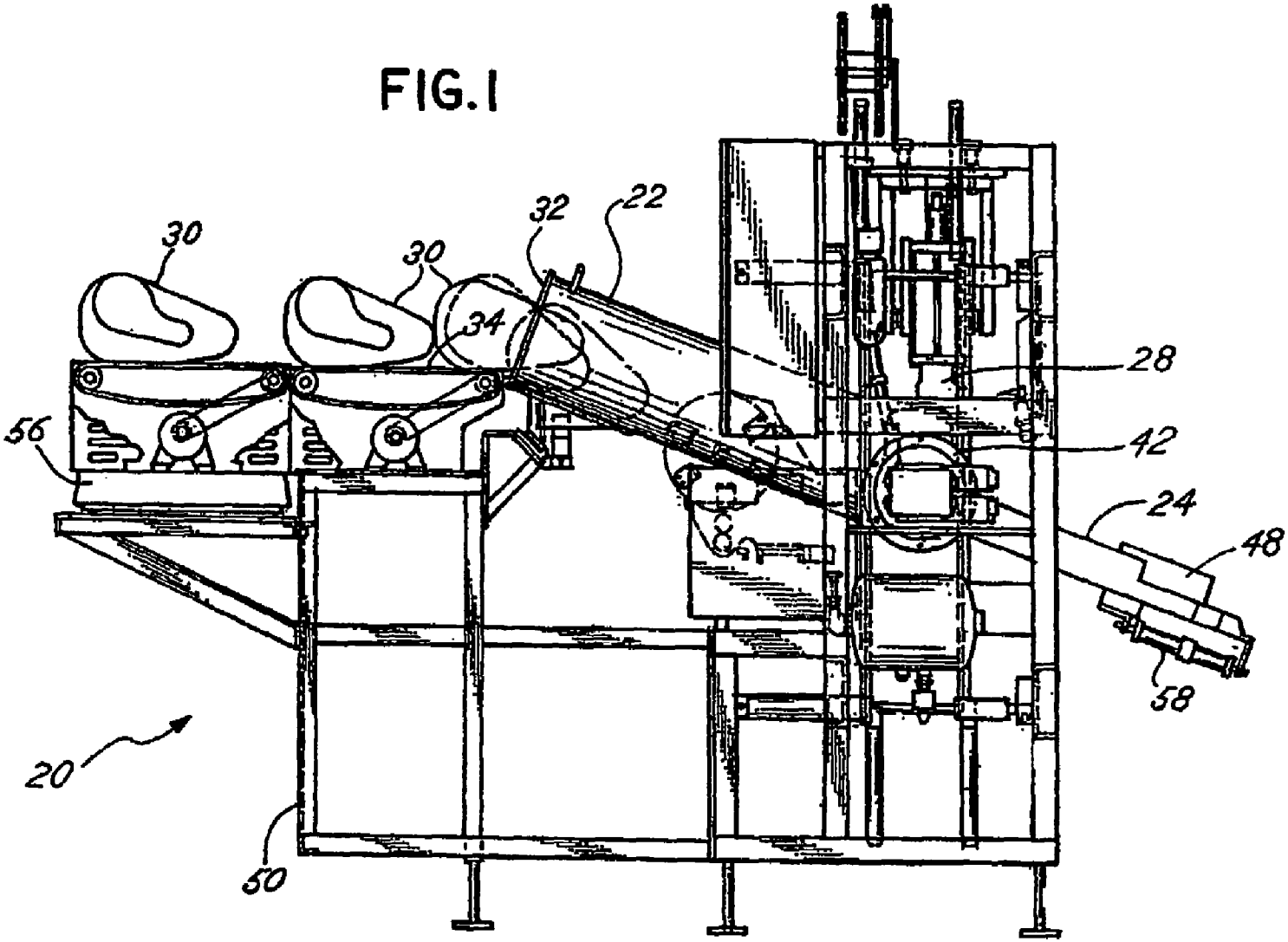
Figure 2:
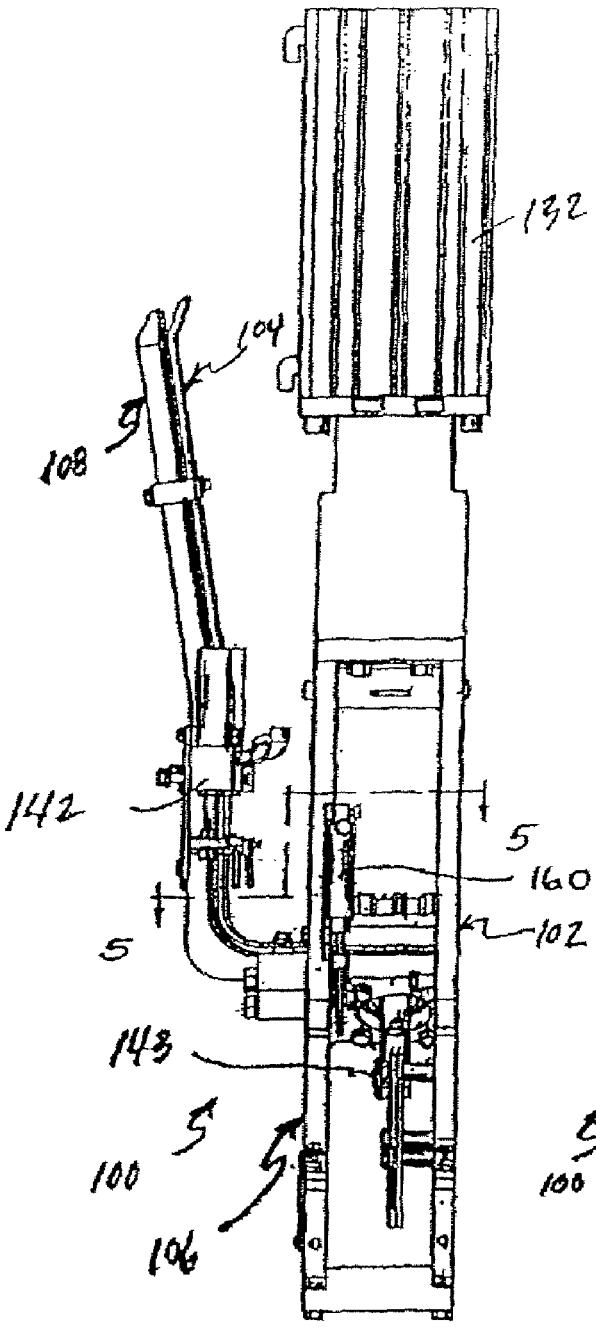
Figure 3:
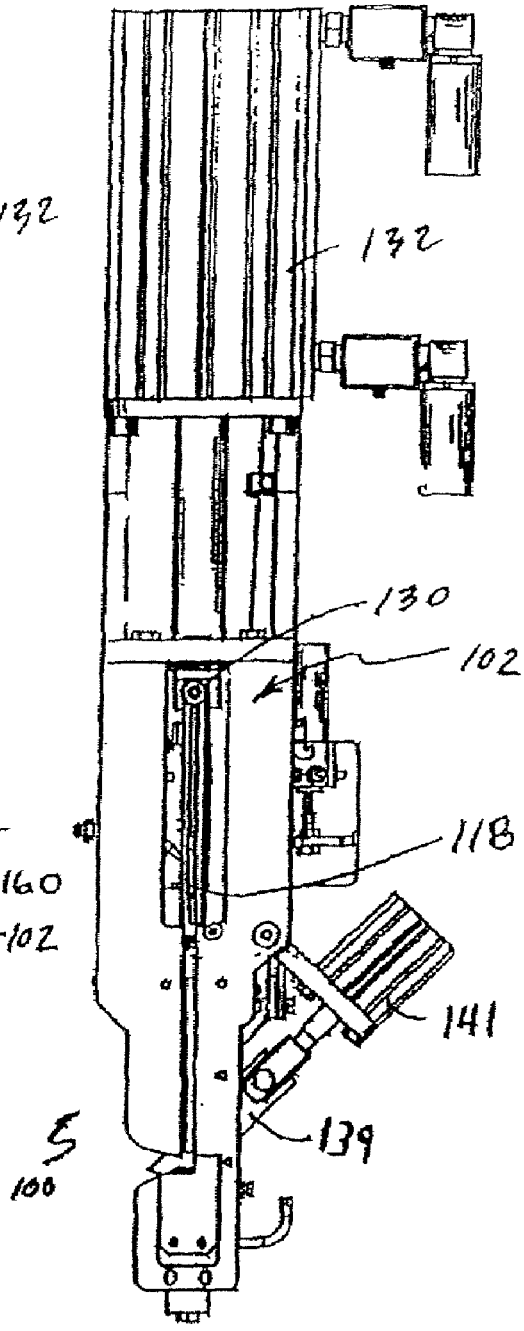
Figure 4:
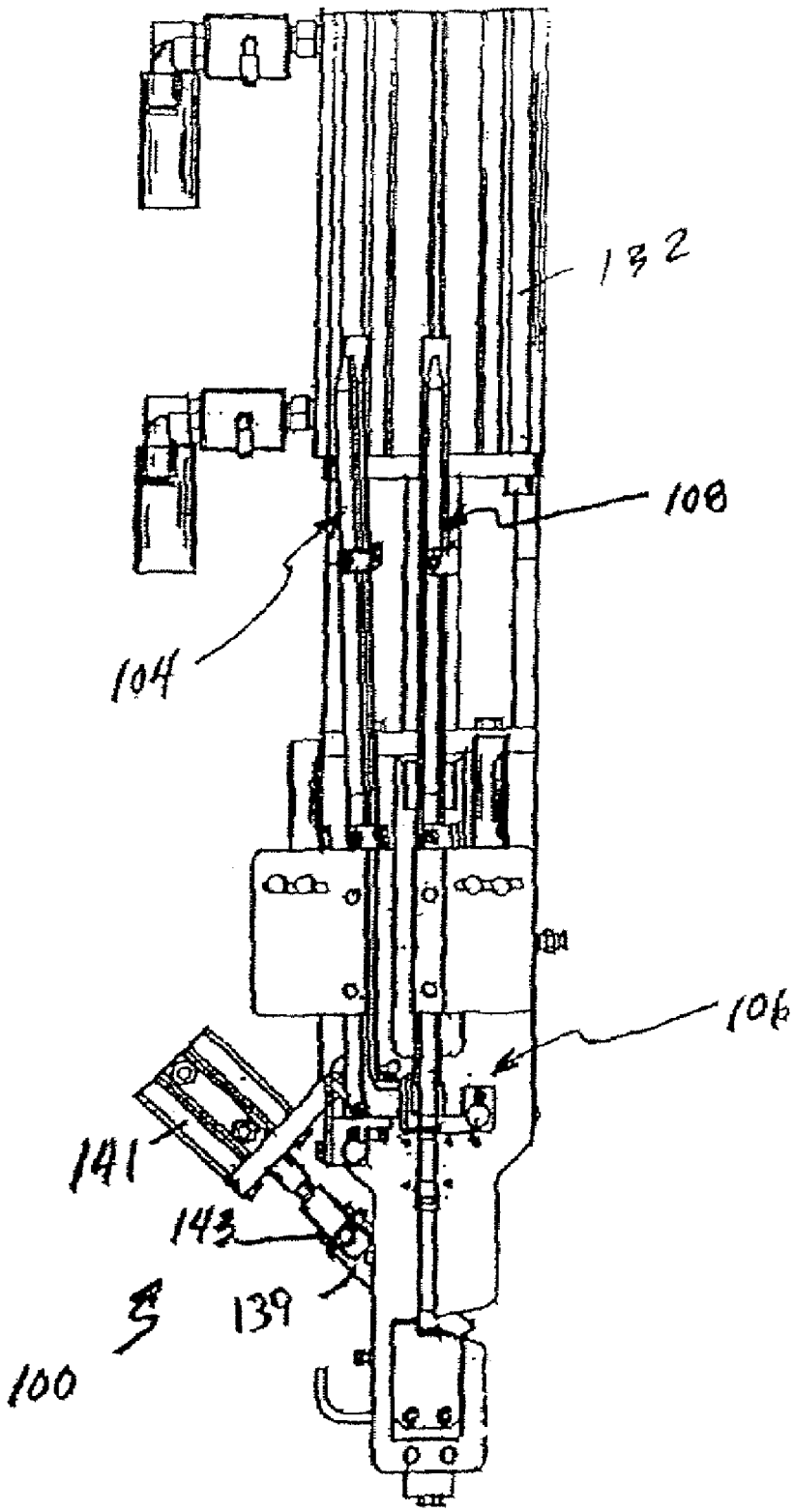
Figure 5:
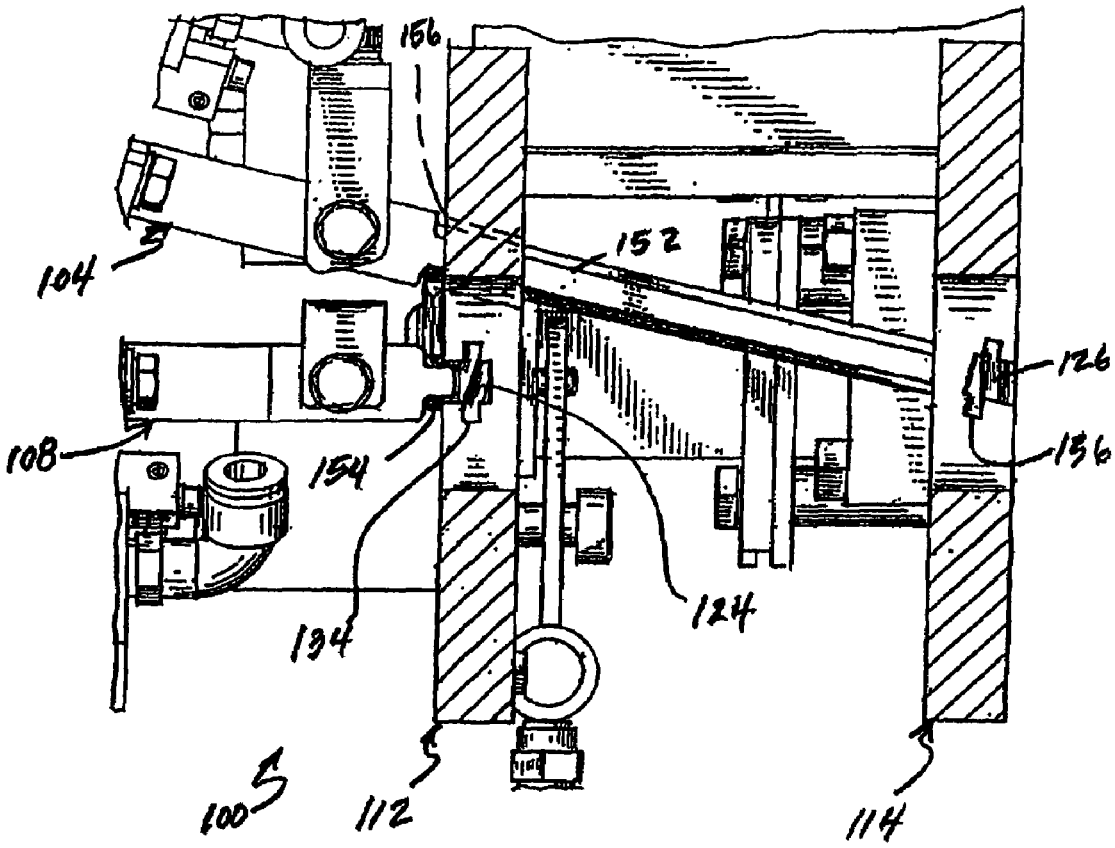
Figure 6:
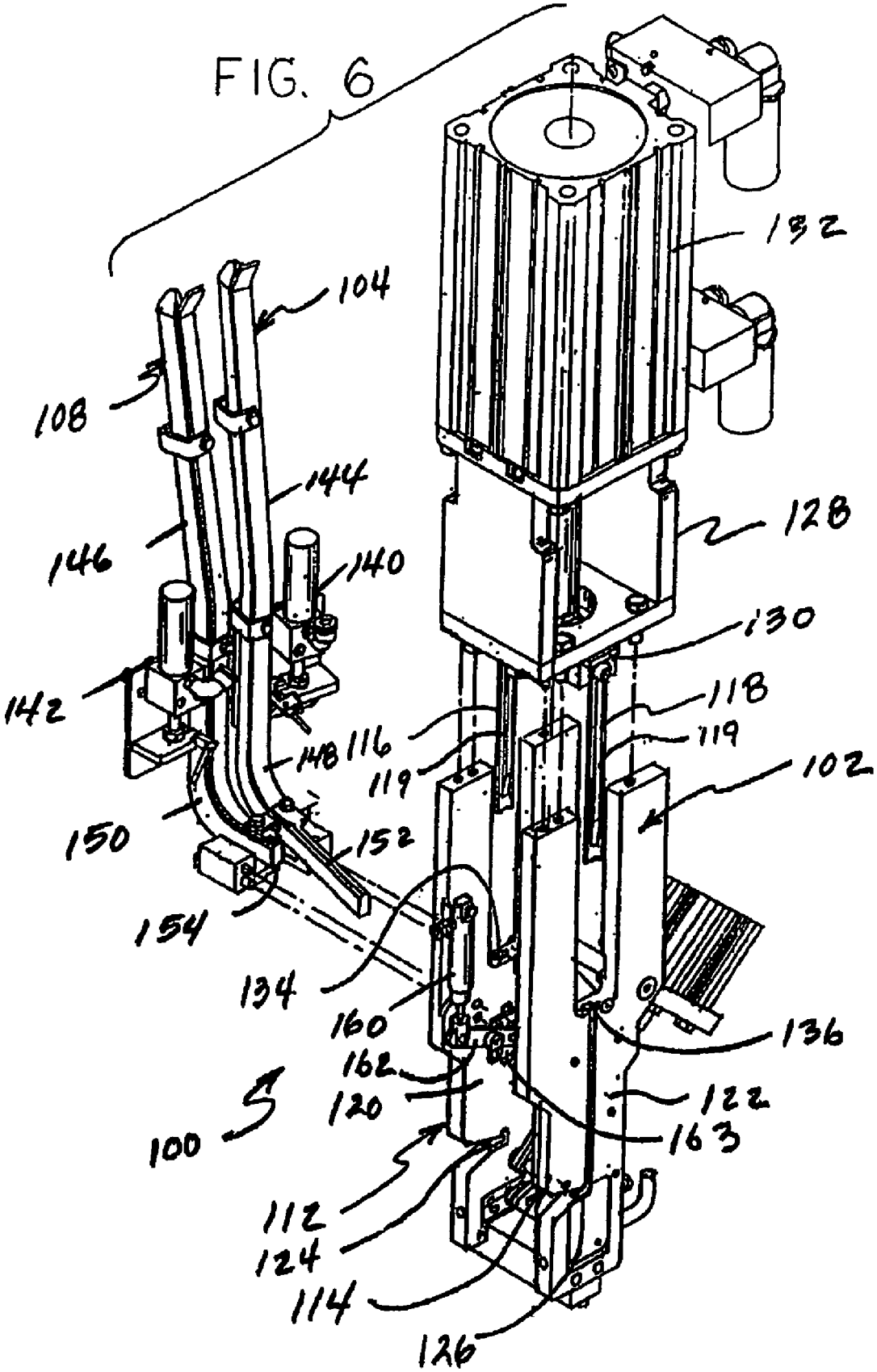

For orientation of the reader to the drawing, and for ease of beginning of reading of the following detailed description, a brief description of the drawing is as follows:

FIG. 1 is a front elevation view of the preferred netting machine of the invention;

FIG. 2 is a front elevation view of the preferred clipper of the preferred embodiment, with the sides of the clipper to the left and right sides, and with the direction of product movement through associated machinery and the clipper being from one side to another, left to right, or alternatively, right to left;

FIG. 3 is a side elevation view of the preferred clipper of FIG. 2, from the right side of FIG. 2;

FIG. 4 is another side elevation of the clipper of FIG. 2 from the opposite side from FIG. 3;

FIG. 5 is a cross-section view of the clipper along line 5—5 in FIG. 2, showing in part and especially the clip rails as they enter the die supports and the dies of the clipper; and FIG. 6 is an exploded perspective view of the clipper of FIG. 2 with the front, as in FIG. 2, facing to the lower left, the right side facing to the lower right, the left side facing to the upper left, with the clip rails separated from the main body of the clipper, and with the drive and punches also separated from the main body.

DETAILED DESCRIPTION OF THE PREFERRED EMBODIMENT

The preferred product netting machine of the invention, as in FIG. 1, is a machine 20 that comprises, in major part, a chute 22, a product receiver or platen 24, voiders in the area 42, and a clipper 100 (FIGS. 2–6). The chute 22 receives products, such as dressed turkeys 30, serially through a chute receiving end 32, as from a conveyor 34, and discharges them serially into netting preferably rucked on the chute. The products are manually placed on the conveyor. As each product arrives at the product receiver or platen or tray, the voiders operate to form a rope section of the netting behind the product, at the chute's discharge end. The clipper 100 also clips the netting, to complete the netting of the product, and clips and cuts the netting to create the starting end of the next netted product. With a machine as described, products are serially or successively netted and clipped. The mechanisms of the invention are under the control of a pneumatic controller, with operator input (not shown).

The machine also includes a netting handle former in the area 42. This former operates to loop the rope section behind the product, before clipping, to form a looped handle for a product in the rope section of the netting. The netting that is clipped behind the products is the netting formed into the loops or handles, and thus, the clips that are put on by the clipper 100 secure the loops in a consistent size and condition.

Also, the machine has a number of valuable mechanisms, components and structures, mounted on a frame 50, a form of base. The product receiver is preferably a discharge tray, inclined outward to discharge products, and there are product guides 48 on the tray to straighten the product, align it for netting, and also to co-operate with the voiders to help tighten the product packaging. As another example, the clipper 100 also preferably is uniquely structured in its clip rails to contribute to tighter packaging. As a third example, the chute is gravity driven and includes product ribs or rails for centering and ease of movement of products. As a fourth example, the handle former is an essentially two-part, mechanically actuated disc and clam shell construction that reaches for the netting, captures it, and rotates a loop into it, while tightening the packaging, in co-ordination with the voiders. Still further, the unit may be equipped with a weight scale 56 in the area of the conveyor, to permit product weighing and tagging. To further the tagging, the machine may be equipped to print a tag as the product proceeds down the chute, to be fed under the clip and be clipped to the specifically weighed product.

In another aspect, then, the preferred embodiment constitutes a method of product netting. This method utilizes the preferred machine and comprises automatically moving products from a conveyor, serially, through a chute into netting to enclose the product and begin the method of netting the product. The netting material is voided behind the product to form the rope section as described with the machine, and the material is clipped, also as described with the machine. The method includes forming the loop handle of the rope section and clipping the loop to form a secure, looped handle for a product, and a tight net package for the product as well.

The preferred embodiment also constitutes the netted, handled, clipped product, and such products that are also further weighed and tagged.

As indicated, the clipper 100 clips the netting, to complete the netting of the product, and clips and cuts the netting to create the starting end of the next netted product. The clipper has a flush side, the right side 102 in FIG. 2 (as also in FIG. 1). This allows the clipper to be placed in the relatively tight location of the associated machine, of the netting type, chub forming type or other type.

Unconventionally, and as seen by comparing and contrasting FIGS. 2, 4 and 6, a clip rail 104 normally on one side, the right side 102, is located to the opposite side, the left side 106, such that from the one side, the left side 106, two clip rails 104, 108 feed clipper mechanisms, to be described, on both sides of the clipper. To accommodate the second clip rail 104 on the common side, the second clip rail 104 is angled into the opposite side anvil location, as will be explained, and the second clip rail 104 passes through the clip die support structure of the other clip die and anvil, also as will be explained. The opposite side clip groove, to be identified, is straight. The other clip rail, that is straight, feeds an angled clip groove. Thus, the angle between clip rails and clip grooves is the same for both clip mechanisms. The clipper dies are ribbed for columnar support, with the ribs turned toward the same side of the clipper. With a machine as described, products are serially or successively formed and clipped.

Referring again to FIG. 2, as seen from the front, the clipper 100 has the clip rail 104 and the clip rail 108 on the left side. There is no clip rail on right side 102. Whereas normally clip rail 104 is on the right side 102, clip rail 104 is located to the left side 106. Referring especially to FIGS. 4 and 6, the two clip rails 104, 108 are side-by-side, or "sidewardly adjacent" to each other.

Referring to FIG. 6, the clipper 100 has two clipper mechanisms 112, 114. Each clipper mechanism 112, 114 includes a punch 116, 118, respectively, a die support 120, 122, respectively, a die or anvil 124, 126, respectively, and a common drive 128. The punches 116, 118 are movable in the die supports 120, 122, up and down through a lower portion of the die supports 120, 122 under action of the drive 128. A yoke or punch support block 130 transfers power from a pneumatic cylinder 132 to each punch 116, 118. The punches are movable in clip channels 134, 136 (FIG. 6), and they drive clips (not shown) downward into the dies 124, 126.

The punches 116, 118 are ribbed along their lengths. Each punch has a rib 119 (FIG. 6) on the right punch side, which tapers away near the forward and downward end of the punches. The ribs aid columnar support of the punches, as the punches drive clips against the dies 124, 126. As illustrated, the ribs are on the sides of the punches opposite the clip rails. This orientation affords a flat surface on the side toward the clip rails for mating with the clip rail ends.

As seen best in FIGS. 2–4, a knife 139 is located between the clipper mechanisms 112, 114. Products that are clipped are separated from each other by the knife 139. A pneumatic cylinder 141 drives the knife 139. A quick removal pin 143 (FIGS. 2 and 4) allows change of knife blades quickly. This reduces machine down time.

Referring to FIGS. 5 and 6, clips arrive in the clip channels 134, 136 above the dies 124, 126 through windows in the die supports 120, 122 after coming down the clip rails 104, 108. The clips are moved down the clip rails both by gravity and under action of clip pushers 140, 142.

As in FIG. 6, the clip rails 104, 108 extend generally vertically at portions 144, 146 and curve at portions 148, 150 to extend generally horizontally at portions 152, 154. Clip rail 104 extends significantly further horizontally in its portion 152 than rail 108 extends in its portion 154. Accordingly, as in FIG. 5, portion 152 extends to the more distant, or remote, clipper mechanism 114, while portion 154 extends to the nearer, or proximal, clipper mechanism 112. Portion 152 also extends through a rail-pass-through opening 156 in the die support 120 provided for portion 152. The opening 156 is horizontally adjacent the clip feed window (not shown) in the die support 120.

Also as in FIG. 6, the generally horizontal portion 152 of the clip rail 104 angles relative to and toward the other portion 154 of the other clip rail 108. Accordingly, as in FIG. 5, the portion 152 angles alongside the die 124 as the portion 152 extends through the die support 120. The die 124 and the associated clip channel 134 and punch 116 are clear of any interference with the clip rail 104. For the same spatial relationship between clip rail 104 and its associated die 126 as exist between clip rail 108 and its associated die 124, die 126 is angled to the same extent as portion 152 of the clip rail 104 is angled. Portion 154 of rail 108 and die 126 are straight, i.e., perpendicular to the left side 106 of clipper 100. As most preferred, the angle of the clip rail horizontal portion 152 is approximately fifteen degrees. Both dies 124, 126 form wrap-around clips.

Air cylinders of the clip pushers 140, 142, drive pusher drive blocks and pawl blocks joined together by pins. The blocks engage the clips on the rails and move them forward, under reciprocating action of the air cylinders. Clip guides mounted by brackets to overly the clip rails assist clip retention and guidance on the clip rails.

In sum, the clip rails 104, 108 are sidewardly adjacent clip feed rails, and the clip pushers 140, 142 feed clips from the rails to between the punches and the anvils. Successively netted and clipped products are formed by the preferred product netting machine, and as a step of the netting and clipping, clips pass from the adjacent clip rails 104, 108 to between the punches and the dies or anvils. The clips are formed by the force of the punches driving downward, pressing the clips into the dies, where they deform into curved shapes, to clip product ends.

With the mechanisms of the preferred machine driven by pneumatic cylinders as described, and with the timing of the cylinders set automatically, the machine applies netting to products essentially automatically, reliably, and at high speed, where the products include whole turkeys, hams, shellfish, and similar items in a variety of industries. With extra mechanisms including a tag printer and a mechanism to feed printed tags under a clip, the machine weighs, tags, bags, and provides consistently sized consumer handles for better-looking finished products, in series, in a safe and efficient netting machine.

A desirable tag feed mechanism, for example, includes an air cylinder 160 (FIG. 6) driving a linkage 162 that lifts and lowers a slide block 163. The tangs of tags are fed into a tag feed window (not shown) in the clip channel 134, below the clip feed window (not shown). The tag bodies preferably remain outside, to the left side 106, of the clipper 100. The slide block 163 holds tangs, one at a time, in series, when lowered. The tag tangs are engaged by clips driven down the clip channel 134 by the punch 116, and fastened to products under those clips. With a scale and printer, the tags may contain information identifying the business establishment in which the clipper is operated, product weight, brand, date, and the like.

The machine with the described clippers may be provided with all electronic controls for actuating the pneumatic (air) cylinders of the clippers. As shown, clips are driven preferably identical distances by the punches and applied two at a time simultaneously. The other mechanisms are coordinated with the punches.

The machine may also be constructed of stainless steel, may meet USDA requirements, be suitable for harsh environments, and be washable for sanitation. With the flush right side 102, and with products moving from left to right, clips are applied closely on the ends of exiting products, keeping them tight. Clippers can alternately be constructed for a flush left side and product movement in either direction, as desired.

The preferred embodiment and the invention are now described in such full, clear, concise and exact terms as to enable a person of skill in the art to make and use the same. To particularly point out and distinctly claim the subject matter regarded as invention, the following claims conclude this specification.

What is claimed is:

1. A product netting machine comprising:

a base;

a chute on the base having a receiving end for receiving products, and a discharge end for discharging products;

a rucker for receiving netting and permitting netting to move with discharged products from the chute discharge end;

a product receiver on the base at the discharge end of the chute;

voiders on the base operated to form a rope section of the netting between the product receiver and the discharge end of the chute when a discharged product is on the product receiver; and a clipper on the base operated to clip the rope section of the netting, the clipper including at least two die supports, at least two punches mounted for movement on the die supports, at least two anvils, a drive to intermittently drive the punches to the anvils, two clip feed rails mounted adjacent to each other on the same side of said die supports and clip pushers to feed clips from the rails to between the punches and the anvils;

whereby successively netted and clipped products are formed by the product netting machine, and as a step of the netting and clipping, clips pass from the adjacent clip rails to between both the punches and both the anvils.

2. A product netting machine as in claim 1, one feed rail extending across at least one of the die supports;

whereby successively netted and clipped products are formed by the product netting machine, and as a step of the netting and clipping, clips pass from one side to another side of the die support along the feed rail that extends across the one of the die supports.

3. A product netting machine as in claim 1, the clipper moving in a central plane with outer sides generally parallel to the plane, and one clipper outer side being free of any outwardly extending clip rail; whereby successively netted and clipped products are formed by the product netting machine, and as an aspect of the machine, the clipper-free clipper outer side permits enhanced placement of clips.

4. A product netting machine as in claim 1, one feed rail extending across at least one of the die supports; the clipper moving in a central plane with outer sides generally parallel to the plane, and one clipper outer side being free of any outwardly extending clip rail; whereby successively netted and clipped products are formed by the product netting machine, and as a step of the netting and clipping, clips pass from one side to another side of the die support along the feed rail that extends across the one of the die supports and the clipper-free clipper outer side permits enhanced placement of clips.

5. A product netting machine as in claim 1, one feed rail extending through at least one of the die supports.

6. A product netting machine as in claim 1, one feed rail extending adjacent its respective die support perpendicular to the major plane of the die and one feed rail extending adjacent its respective die support at an angle to the perpendicular to the major plane of the die.

7. A clipper for a product netting machine, the clipper comprising:

at least two die supports;

at least two punches mounted for movement on the die supports;

at least two anvils;

a drive to intermittently drive the punches to the anvils;

two clip feed rails mounted adjacent to each other on the same side of said die supports; and clip pushers to feed clips from the rails to between the punches and the anvils;

whereby successively netted and clipped products are formed by the product netting machine, and as a step of the netting and clipping, clips pass from the adjacent clip rails to between both the punches and both the anvils.

8. A clipper as in claim 7, one feed rail extending across at least one of the die supports;

whereby successively netted and clipped products are formed by the product netting machine, and as a step of the netting and clipping, clips pass from one side to another side of the die support along the feed rail that extends across the one of the die supports.

9. A clipper as in claim 7, the clipper moving in a central plane with outer sides generally parallel to the plane, and one clipper outer side being free of any outwardly extending clip rail;

whereby successively netted and clipped products are formed by the product netting machine, and as an aspect of the machine, the clipper-free clipper outer side permits enhanced placement of clips.

10. A clipper for a product netting machine as in claim 7, one feed rail extending across at least one of the die supports; the clipper moving in a central plane with outer sides generally parallel to the plane, and one clipper outer side being free of any outwardly extending clip rail;

whereby successively netted and clipped products are formed by the product netting machine, and as a step of the netting and clipping, clips pass from one side to another side of the die support along the feed rail that extends across the one of the die supports and the clipper-free clipper outer side permits enhanced placement of clips.

11. A clipper as in claim 7, one feed rail extending through at least one of the die supports.

12. A clipper as in claim 7, one clip feed rail, a first feed rail, extending adjacent its respective die support, a first die support, perpendicular to the major plane of the respective die and one clip feed rail, a second feed rail, extending adjacent its respective other die support, a second die support, at an angle to the perpendicular to the major plane of the respective other die.

13. A clipper as in claim 11, the first die support having a first clip-forming die and the second die support having a second clip-forming die, the first clip-forming die being angled to the major plane of the respective die and the second clip-forming die being perpendicular to the major plane of the respective other die.

* * * * *